US007357241B2

(12) United States Patent
Schmidt et al.

(10) Patent No.: US 7,357,241 B2
(45) Date of Patent: Apr. 15, 2008

(54) DEVICE FOR RESTRAINING THE RISE OF A STEP ROLLER OF A PEOPLE CONVEYOR

(75) Inventors: Rainer Schmidt, Lindhorst (DE); Andreas Stuffel, Bückeburg (DE); Jeong Rak Kim, Incheon (KR)

(73) Assignee: Otis Elevator Company, Farmington, CT (US)

( * ) Notice: Subject to any disclaimer, the term of this patent is extended or adjusted under 35 U.S.C. 154(b) by 71 days.

(21) Appl. No.: 10/579,005

(22) PCT Filed: Nov. 29, 2004

(86) PCT No.: PCT/EP2004/013529

§ 371 (c)(1),
(2), (4) Date: May 11, 2006

(87) PCT Pub. No.: WO2005/051831

PCT Pub. Date: Jun. 9, 2005

(65) Prior Publication Data

US 2007/0144866 A1 Jun. 28, 2007

(30) Foreign Application Priority Data

Nov. 29, 2004 (KR) ..... 10-2003-0085911

(51) Int. Cl.
*B66B 23/14* (2006.01)

(52) U.S. Cl. ..... 198/333; 198/327

(58) Field of Classification Search ..... 198/326, 198/327, 333

See application file for complete search history.

(56) References Cited

U.S. PATENT DOCUMENTS

| | | | | |
|---|---|---|---|---|
| 4,175,652 | A * | 11/1979 | Satou et al. | 198/332 |
| 4,569,433 | A * | 2/1986 | Ishida et al. | 198/333 |
| 4,681,207 | A | 7/1987 | Goto et al. | |
| 5,170,875 | A * | 12/1992 | Kubota | 198/328 |
| 5,472,075 | A | 12/1995 | Yamashita et al. | |
| 5,487,449 | A | 1/1996 | Barrett et al. | |

(Continued)

FOREIGN PATENT DOCUMENTS

EP 1 338 548 A1 8/2003

(Continued)

OTHER PUBLICATIONS

PCT International Search Report for PCT/EP2004/013529, dated Mar. 21, 2005.

(Continued)

*Primary Examiner*—Mark A. Deuble

(57) ABSTRACT

People conveyor (2) including an endless conveyor band (4) extending through an inclined portion (6), a first and a second turnaround portions (8) and a return portion (5) of an endless path and comprising a plurality of steps (10) connected to and driven by a step chain (12), the steps (10) comprising a step roller (18), the people conveyor (2) further including a step roller track (20) for guiding the step roller (18), the step roller track (20) extends along the path of the conveyor band (4) and has an inner and an outer rails (24, 22) for supporting the step roller (18), and a device (20) for restraining the step roller (18) against one of the inner and outer rails (24, 22).

13 Claims, 9 Drawing Sheets

U.S. PATENT DOCUMENTS

| | | | | |
|---|---|---|---|---|
| 5,695,040 | A * | 12/1997 | Watanabe et al. | 198/333 |
| 5,992,605 | A | 11/1999 | Haruta | |
| 6,832,678 | B2 * | 12/2004 | Ogura et al. | 198/322 |

FOREIGN PATENT DOCUMENTS

| | | |
|---|---|---|
| GB | 16267 | 3/1911 |
| GB | 203033 | 8/1923 |
| GB | 491301 | 8/1938 |
| GB | 492715 | 9/1938 |
| GB | 549616 | 11/1942 |
| JP | 04-020495 | 1/1992 |

OTHER PUBLICATIONS

PCT Written Opinion for PCT/EP2004/013529, dated Mar. 21, 2005.

PCT International Preliminary Examination Report, dated Apr. 4, 2006.

* cited by examiner

FIG.5a
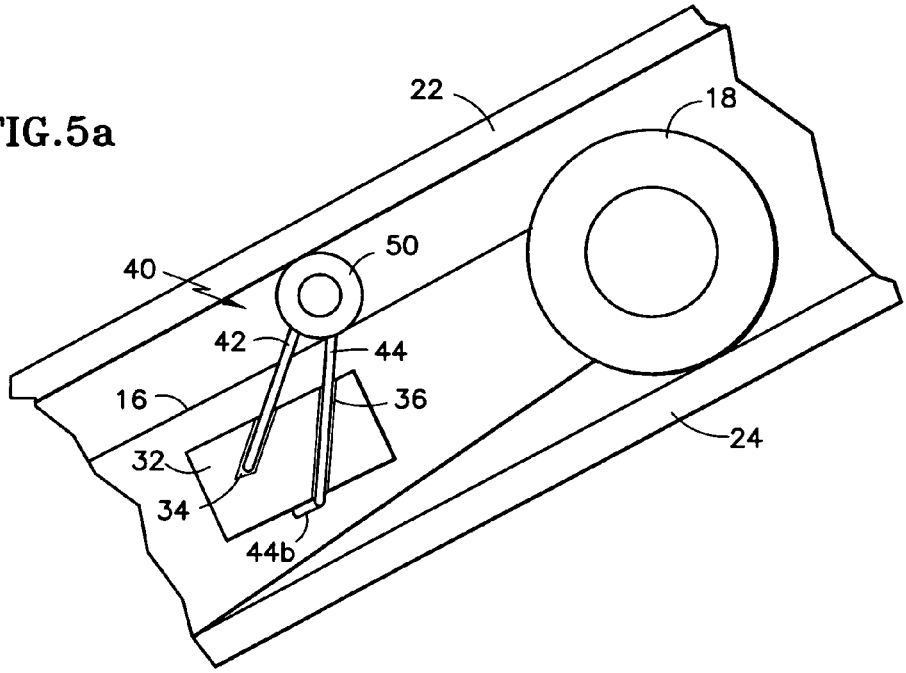
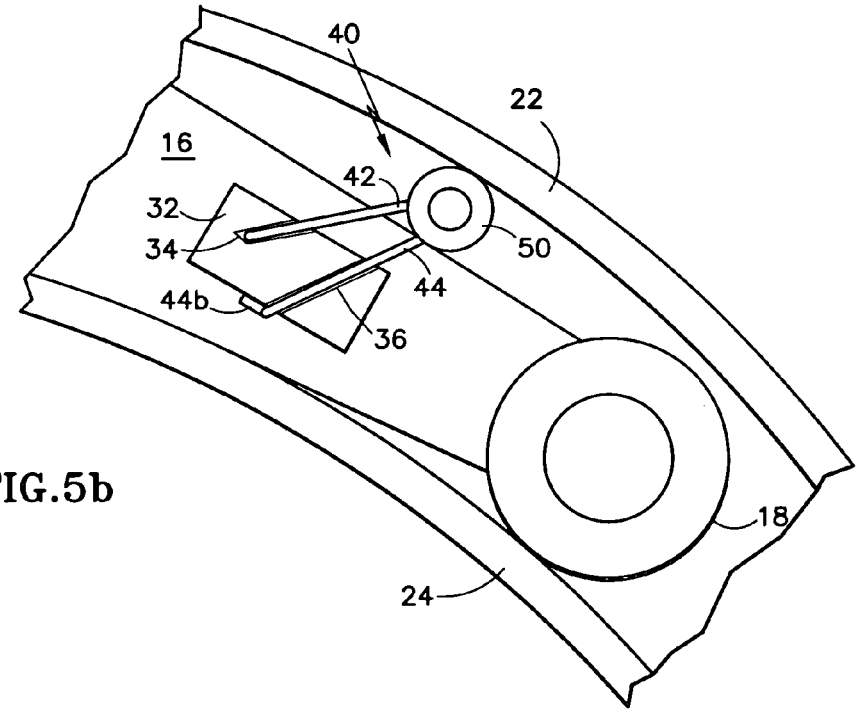
FIG.5b

DEVICE FOR RESTRAINING THE RISE OF A STEP ROLLER OF A PEOPLE CONVEYOR

FIELD OF THE INVENTION

The present invention generally relates to people conveyors and particularly to moving walks and escalators, and more particularly to a device for restraining a step roller from rising to collide with a rail of a track in turn around areas located for example at the top and bottom of the escalator.

DESCRIPTION OF THE RELATED ART

A typical people conveyor like an escalator or moving walk includes an endless conveyor band extending through an inclined portion, a first and a second turn around portion and a return portion of an endless path and comprising a plurality of steps which are typically rotatably connected to and driven by a step chain. The steps each comprise a step roller and the people conveyor further includes a step roller track for guiding the step rollers. The step roller track extends along the path of the conveyor band and has an inner rail and an outer rail for supporting the step rollers. In case of a moving walk the "steps" are commonly referred to as pallets, with the treat surfaces thereof being generally arranged within a single plane along the transportation portion thereof. With an escalator, the treat surfaces of the individual "steps" are at different vertical levels in the inclined portion of the conveyor band.

A typical escalator, and similar a moving walk, includes a frame, balustrades with movable handrails, steps, a drive system and a step chain for propelling the steps. The frame includes a truss section on both left and right hand sides of the frame. Each truss section has two end sections forming landings, which are connected by an inclined midsection. The upper landing usually houses the escalator drive system or machine positioned between the trusses.

The drive system of the escalator typically consists of a step chain, a step chain drive sprocket, an axle and a drive motor. The drive motor drives the step chain to travel a continuous closed loop.

As shown in FIGS. 1 and 2, steps 10, which are attached to a step chain 12, run from one landing to the other in order to transport the passengers.

Support arms 16 are fixedly coupled to both sides of the step 10. Each support arm 16 is provided with a step roller 18, which is rotatably mounted to an end of the support arm 16. The step roller 18 guides the movement of the step 10 and further supports the same.

An escalator has a track 20 on both left and right sides, along which the step roller 18 travels a continuous closed loop. The track 20 is substantially parabolic in shape at the turn around areas, which are located under the lower and upper landings, so that the step roller 18 and the step 10 can make a 180 degree heading change at the turn around areas.

The track 20 includes an inner rail 24 and an outer rail 22 that is disposed outward of the inner rail 24. The gap between the inner rail 24 and the outer rail 22 is set to be a little larger than the diameter of the step roller 18. The outer rail 22 has a L-shape to prevent the step roller 18 from separating transversely from the track 20.

At the passenger conveying portion, the step roller 18 rolls on the inner rail 24 of the track 20. Since the step 10 moves upward, the step roller 18 rises from the inner rail 24 to the outer rail 22 when the step roller 18 advances into the curved portion of the track 20 at the upper turn around area.

This is due to the inertia of the moving step 10 and/or gravity. As such, the step roller 18 collides with the outer rail 22. Then, the step roller 18 descends toward the lower landing with rolling on the outer rail 22 and returns onto the inner rail 24 at the lower turn around area.

However, the collisions of the step roller with the rails of the track cause undesired noise and operational instability, thus making the passengers feel very uncomfortable. Such collisions may even lead to malfunction of the escalator or moving walk.

SUMMARY OF THE INVENTION

It is an object of the present invention to reduce the noise generation with a people conveyor and particularly the noise generation as caused by the collisions of the step rollers with the rails of the track and to eliminate the problems related therewith, for example operational instability, etc.

In accordance with an embodiment of the present invention, this object is solved with a people conveyor by means of a device for restraining the step roller against one of the inner and outer rails.

The step roller can either be restrained against the same rail, i.e. the inner rail or the outer rail, during its movement through the closed loop path. Alternatively, the restraining device can provide for a smooth transition from one rail to the other rail in a turnaround portion. Typically, due to gravity, the step roller rolls along the inner track in the passenger conveying portion and along the outer track in the return portion, i.e. along the lower track. The outer track in the passenger conveying portion and the inner track in the return portion only provide an upper contact rail for exceptional circumstances. Such rail is typically termed "upthoust rail". Accordingly, due to gravity, the step roller tends to change from the inner rail to the outer rail and vice versa in the turnaround portions.

Preferably, the restraining device comprises an elastic biasing member for elastically biasing the step roller against one of the inner and outer rails. Alternatively, any other mechanism can be provided which forcibly guides the step roller along a well-determined path avoiding collisions.

Preferably, the restraining device is adapted for allowing a gradual transition of the step roller from one of the inner and outer rails to the other one from inner and outer rails in any of the first and second turnaround portions. Such a construction has the advantage that there is no need to support against gravity the load of a step along either of the passenger conveying portion or the return portion of the endless path. Accordingly, the respective restraining device can be relatively "weak", allowing a space-saving and lightweight construction thereof.

Preferably, the biasing member comprises any type of mechanic, pneumatic, electromagnetic, etc. spring. Alternatively, the biasing member can be made of any elastic or resilient material like rubber, etc.

Preferably, the restraining device is arranged between the step and the drive chain. Accordingly, the restraining device can be positioned between the step and the drive chain so as to elastically bias or to support the step against the drive chain. As will be discussed later on, the restraining device can be arranged between other parts of the people conveyor, for example between the step and the step roller track.

Preferably, there is one drive chain arranged at each lateral edge of the conveyor band, wherein each drive chain comprises a plurality of chain links, wherein a connecting axle connects one chain link on one side of the conveyor band with the corresponding chain link on the other side of the conveyor band. The step can be attached to and supported by this pair of step chain links. With such a construction, the restraining device is preferably arranged between the step and the connecting axle.

Preferably, the restraining device comprises a tortion spring and more preferred, such tortion spring is attached to the connecting axle and is supported thereto with one of its two free ends, while the second free end thereof is arranged so as to engage the step. It is preferred to have the second free end of the tortion spring engaging the lowermost portion of the step riser. The design can be such that the second free end is out of engagement with the step in the passenger conveying portion and the return portion of the endless path and the engagement starts only due to a relative displacement between the step and the connecting axle while moving through the transition portion between the passenger conveying portion and the turnaround portion, and the return portion and the turnaround portion. This cyclic engagement and disengagement between the second free end of the tortion spring and the step can be used for controlling a smooth transition between the inner and outer rails of the step roller track.

Preferably, the restraining device is arranged between the step and the step roller track. Such a construction is particularly preferred with constructions which do not include a connecting axle. It is also contemplated to have a first restraining device between step and roller track and a second restraining device between step and connecting axle within a single construction.

Preferably, the restraining device comprises a supplementary roller and a biasing means for biasing the supplementary roller against one rail of the step roller track. As compared to any sliding means, the supplementary roller has the advantage of relatively moderate wear. A further advantage is the calm operation of the supplementary roller rolling along the rail.

Preferably, the step roller is attached to the step by a connecting arm and more preferred the supplementary roller is supported by the connecting arm. The biasing means can be provided so as to bias the supplementary roller against the outer rail.

Preferably, the biasing means is a linear spring having a first leg and a second leg being bent with respect to each other by a predetermined angle, further comprising a supporting block at the connecting arm. The supporting block comprises a first and second recesses and one portion each of the first and second legs of the linear spring is respectively fitted to the first and second recesses to thereby limit deformation of the first and second legs of the linear spring to a predetermined range. One or both legs can be secured to the supporting block, for example by clamping, welding, brazing, press-fitting, by means of adhesive, etc. Preferably, et least one of the legs has a bent portion for inserting into a corresponding opening in the supporting block and further preferably comprising a cover mounted to the supporting block to prevent the first and/or second legs of the linear spring from being separated from the first and second recesses of the supporting block.

Preferably, the restraining device further comprises a member for supporting a supplementary roller and particularly for attaching a supplementary roller to the linear spring. Preferably, the member has a recess in which a portion adjacent to the junction between the first and second legs of the linear spring is fitted and a cover which covers the recess of the member.

An embodiment of the invention further relates to a device for restraining rise of a step roller of an escalator by moving walk in accordance with any of claims 14 to 19.

Consistent with the foregoing objects, and in accordance with the invention as embodied herein, there is provided a device for restraining the rise of a step roller of an escalator. The escalator includes: steps circulating a closed loop; a track having inner and outer rails and providing the circulating loop of the steps; and a step roller connected to each step by means of a connecting member and rolling along the inner rail of the track. The device of the present invention comprises: a supplementary roller, which is disposed between the outer rail and the inner rail of the track; an elastic member for supporting the supplementary roller; and a supporting block, which is mounted to the connecting member and to which the elastic member is fixed.

The elastic member biases the supplementary roller toward the outer rail of the track in order to roll thereon. The elastic member is a linear spring, which has a first leg and a second leg that are bent with respect to each other by a predetermined angle.

The supporting block has first and second recesses, in which each portion of the first and second legs of the elastic member are fitted, respectively. The first and second recesses limit the deformation of the first and second legs of the elastic member to a predetermined range.

The first leg of the elastic member has a bent portion at its tip, which is pivotably inserted into the supporting block. Further, the second leg of the elastic member has a bent portion at its tip, which contacts a bottom surface of the supporting block.

BRIEF DESCRIPTION OF THE DRAWINGS

Embodiments of the present invention are described below with respect to the drawings, in which:

FIG. 5*a* is a side view showing an operational state of the inventive device when the step roller moves along the track at a passenger conveying area of an escalator.

FIG. 5*b* is a side view showing an operational state of the inventive device when the step roller moves along the track at an upper turn around area of an escalator.

DETAILED DESCRIPTION

Figure 1:
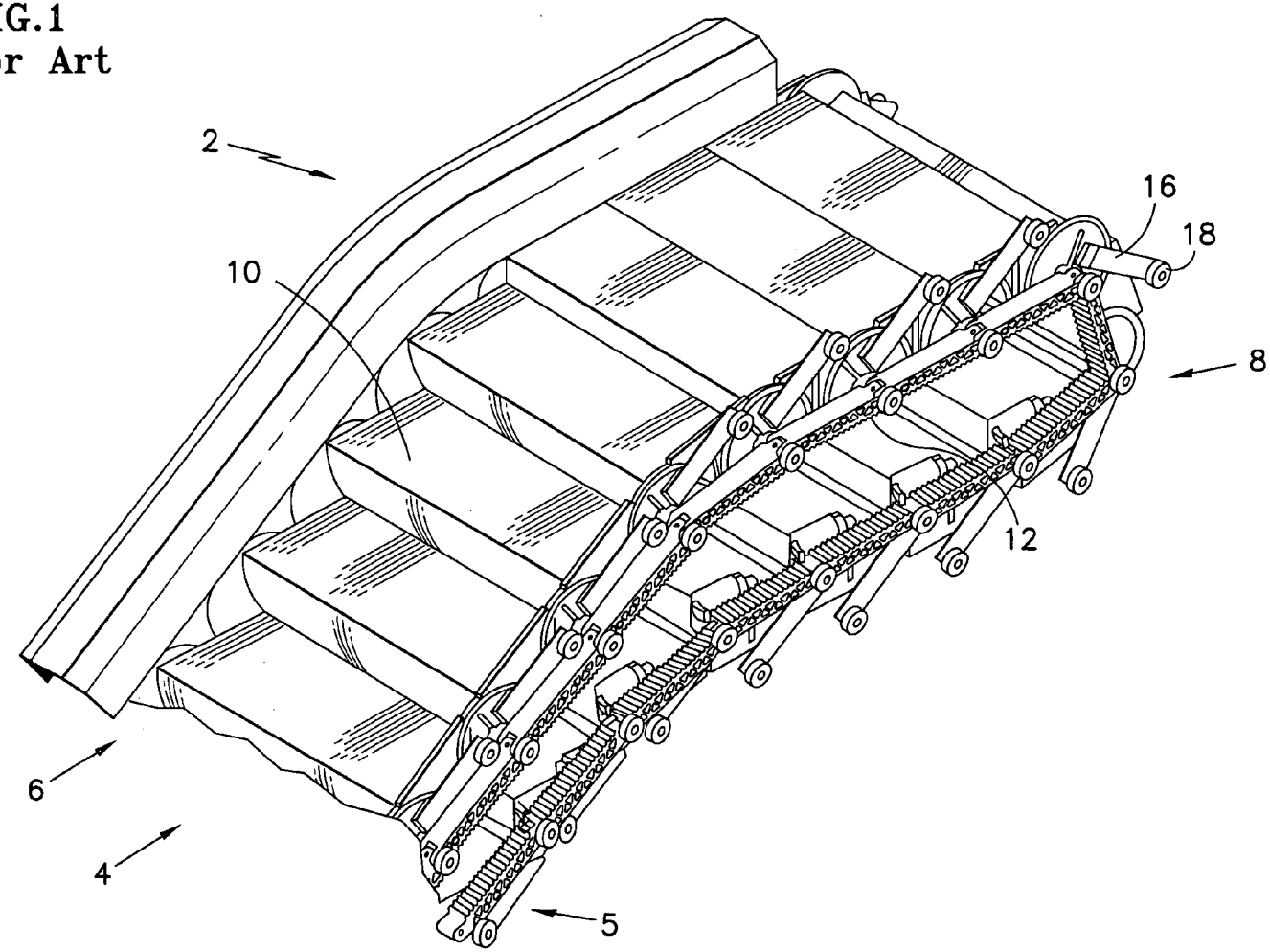
FIG.1 Prior Art
FIG. 1 is a perspective view schematically showing steps and a step chain of a conventional escalator.
Figure 2:
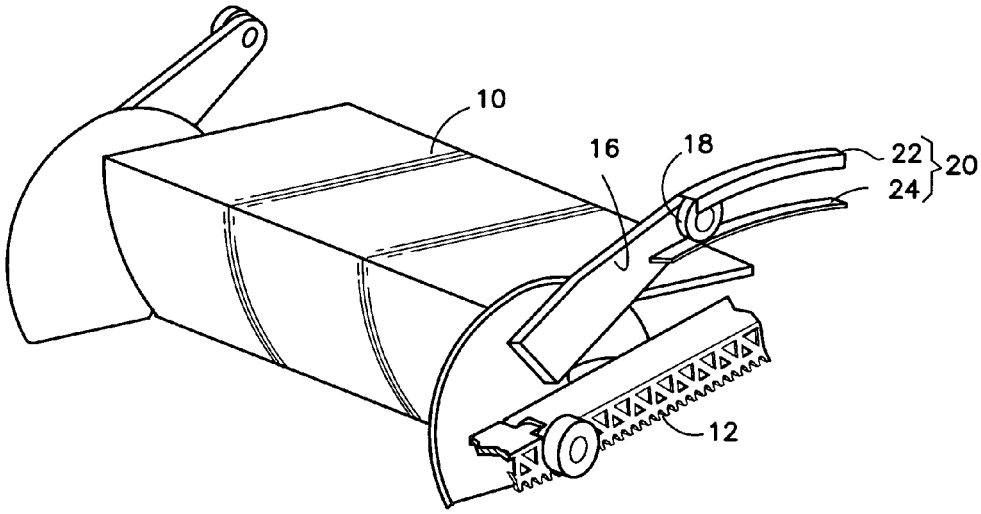
FIG.2 Prior Art
FIG. 2 is a perspective view showing a mounting structure of a step roller and a track of a conventional escalator.
Figure 3:
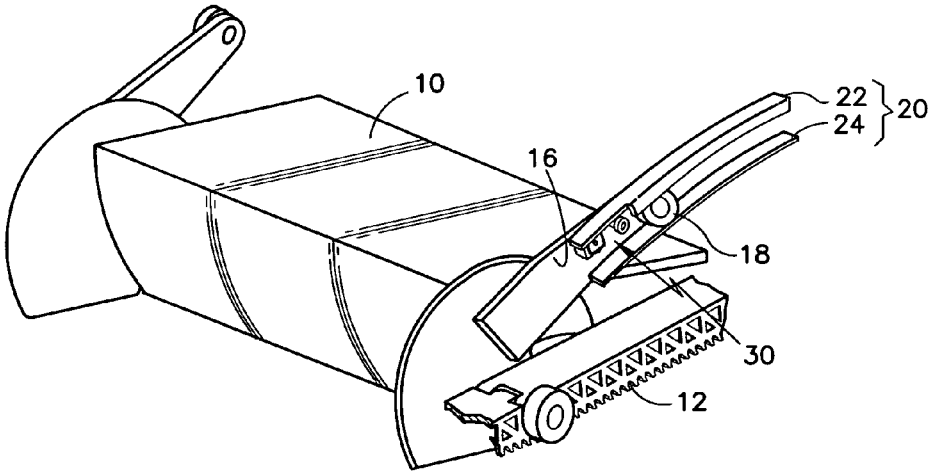
FIG. 3 is a perspective view showing a mounting structure of a track and a device for restraining the rise of a step roller in accordance with a preferred embodiment of the present invention.

FIG. 3 is a perspective view showing a mounting structure of a track and a device for restraining the rise of a step roller of an escalator in accordance with a preferred embodiment of the present invention.

As shown in the drawing, each step 10 is attached to a step chain 12 traveling in a continuous closed loop. Support levers 16 are fixedly coupled to both sides of the step 10. Each support lever 16 is provided with a step roller 18, which is rotatably mounted to an end of the support lever 16. The step roller 18 guides the movement of the step 10 and supports the same.

An escalator has a track 20 on both left and right sides, along which the step roller 18 travels in a continuous closed loop. The track 20 includes an inner rail 24 and an outer rail 22 that is disposed outward the inner rail 24. The gap between the inner rail 24 and the outer rail 22 is set to be a little larger than the diameter of the step roller 18.

Figure 4A:
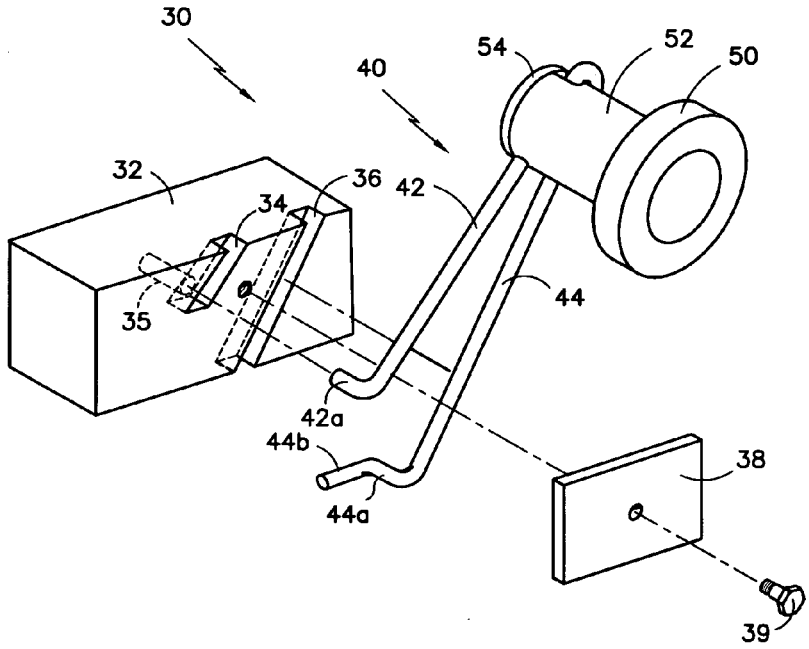
FIG. 4*a* is a front exploded perspective view showing a device for restraining the rise of a step roller in accordance with the present invention.

There is provided a device 30 for restraining the step roller 18 from rising from the inner rail 24 to the outer rail 22, thus preventing it from colliding with the outer rail 22 in the turn around areas at the top and bottom of the escalator. Such device is mounted to the support or connecting arm 16 and will be described in detail hereinafter with reference to FIGS. 4*a* and 4*b*.

The device 30 for restraining the rise of the step roller 18 comprises: a supplementary roller 50, which is in contact with the outer rail 22 of the track 20; an elastic member 40 for biasing the supplementary roller 50 toward the outer rail 22; and a supporting block 32, which is attached to the support arm 16 to support the elastic member 40.

The elastic member 40 is a linear spring, which is configured to have a first leg 42 and a second leg 44 that are bent with respect to each other by a predetermined angle in a Λ shape. The supporting block 32 has first and second recesses 34 and 36 on its front surface, in which the first and second legs 42 and 44 of the elastic member 40 are seated, respectively. The first recess 34 extends downward from the top end of the supporting block 32 by a specific length. The second recess 36 extends downward from the top end of the supporting block 32 to the bottom end thereof. These recesses 34 and 36 are slanted at a predetermined angle toward the step roller 18.

The first leg 42 of the elastic member 40 is provided with a bent portion 42*a* at its tip. The bent portion 42*a* of the first leg 42 is pivotably inserted into an insertion hole 35, which is formed at an end of the first recess 34 of the supporting block 32.

The second leg 44 of the elastic member 40 is provided with a first bent portion 44*a* and a second bent portion 44*b* at its tip. The first bent portion 44*a* extends rearward of the supporting block 32 and is in contact with the bottom surface of the supporting block 32. The second bent portion 44*b* extends from the end of the first bent portion 44*a* and is in contact with the bottom surface of the supporting block 32 so as to serve as a base point of the elastic member 40.

The first and second recesses 34 and 36 of the supporting block 32 are a little wider than the first and second legs 42 and 44 of the elastic member 40. This is so that the elastic member 40 can be deformed within a limited range, which will be described later.

A cover 38 is coupled to the front surface of the supporting block 32 by a fastening means, such as a bolt 39. This is to cover the first and second recesses 34 and 36 and prevent the first and second legs 42 and 44 of the elastic member 40 from being separated therefrom.

Figure 4B:
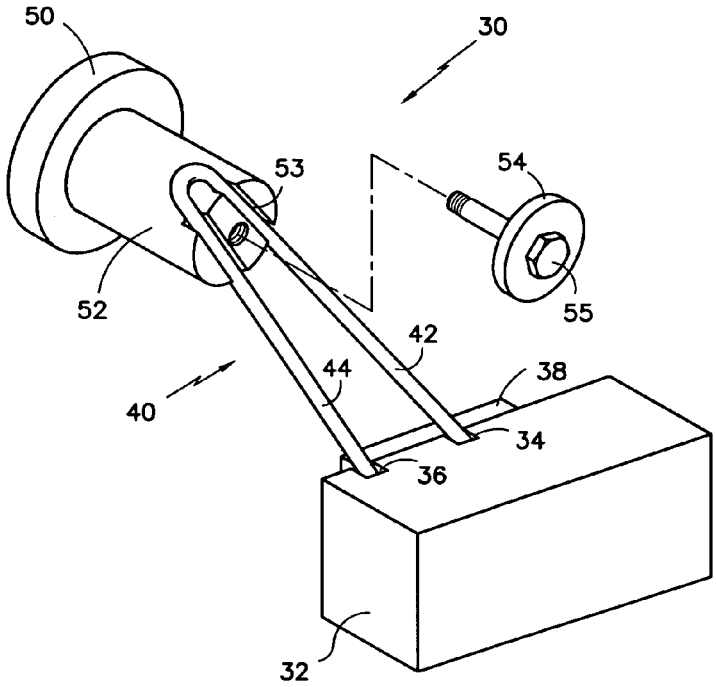
FIG. 4*b* is a rear perspective view showing a device for restraining the rise of a step roller in accordance with the present invention.

As shown in FIG. 4*b*, the elastic member 40 is coupled to a supplementary roller-supporting member 52 at a portion adjacent to the junction between the first and second legs 42 and 44. Receiving slots 53 are formed at the rear surface of the supporting member 52, in which the first and second legs 42 and 44 of the elastic member 40 are seated. Also, a cover 54 is attached to the rear surface of the supporting member 52 by a fastening means, such as a bolt 55. This is to prevent the legs 42 and 44 of the elastic member 40 from being separated from the receiving slots 53.

The operational effects of the device for restraining the rise of the step roller according to the present invention will be described hereinafter based on the assumption that the escalator moves upward.

As shown in FIG. 5*a*, when the step roller 18 moves along the linear portion of the track 20 at the passenger conveying area, the step roller 18 rolls on the inner rail 24 of the track 20. Further, the supplementary roller 50 is biased toward the outer rail 22 of the track 20 by the elastic member 40 and rolls on the outer rail 22.

As shown in FIG. 5*b*, when the ascending step roller 18 arrives at the upper landing and advances into the curved portion of the track 20 at the upper turn around area, the step roller 18 rises toward the outer rail 22 of the track 20. This is due to the inertia force and the supplementary roller 50, which is in contact with the outer rail 22, is subjected to the reactional force to the inertia force and/or gravity force. Therefore, the elastic member 40 is deformed restrictively in such a manner that the first leg 42 pivots within the first recess 34 of the supporting block 32 on the axis of the bent portion 42*a* inserted into the insertion hole 35. Further, the second leg 44 moves within the second recess 36 with the first and second bent portions 44*a* and 44*b* contacting the bottom surface of the supporting block 32. At the same time, the restoring force against the force acting on the step roller 18 and the elastic member 40 is generated between the second bent portion 44*b* of the second leg 44 of the elastic member 40 and the supporting block 32.

When the restoring force of the elastic member 40 is sufficient to overcome the rising force acting on the step roller 18, the step roller 18 stops rising and returns to its original position (i.e., onto the inner rail 24 of the track 20). Accordingly, the step roller 18 is restrained from colliding with the outer rail 22 of the track 20.

Although the restoring force of the elastic member 40 becomes gradually weakened due to repeated operations, the shock and noise caused by the collision of the step roller 18 with the track 20 rarely occur, if any.

By diversely adjusting the material, the rigidity or elasticity of the elastic member 40, the collision of the step roller 18 with the outer rail 22 of the track 20 at the turn around area may be completely restrained as the present embodiment, or may occur so rarely that there is very little shock.

Figure 6:
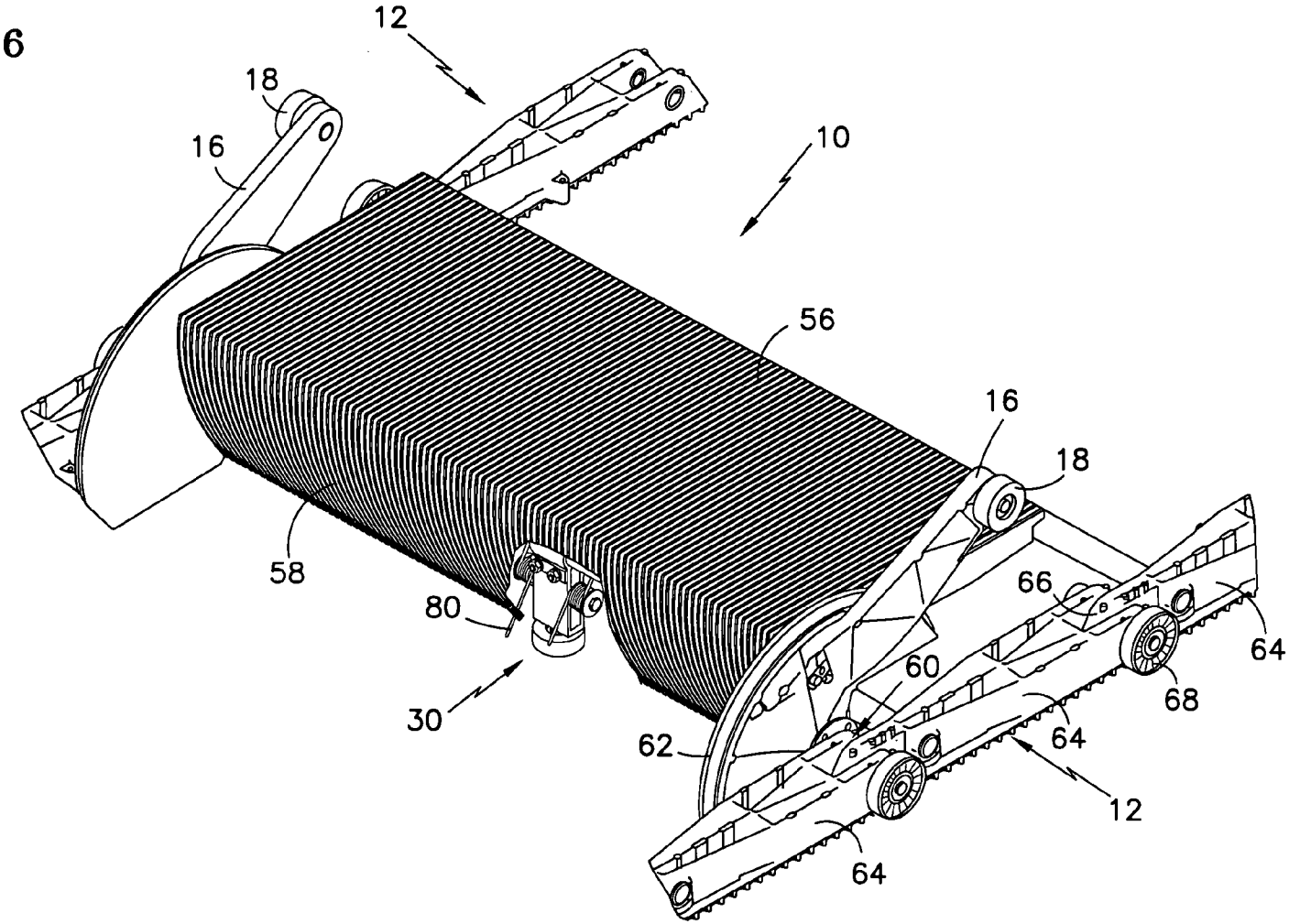
FIG. 6 is a perspective view schematically showing a step and step chain in accordance with a second embodiment of the present invention.
Figure 8:
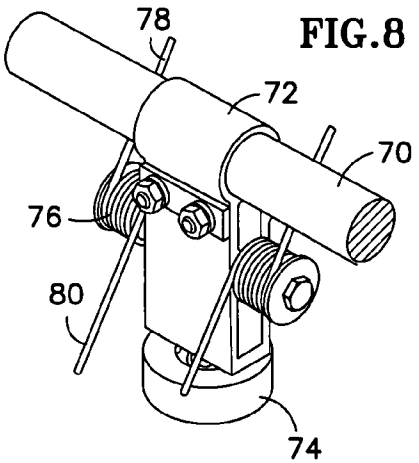
FIG. 8 is a detail as encircled with circle A of FIG. 7.

FIGS. 6 to 12 show a second embodiment of the present invention, the general construction of the respective people conveyor 2 is similar to that of the first embodiment. As can be seen in FIG. 6, the step 10 has a treat surface 56 and a step riser 58. The step riser 58 is partially broken away in order to allow view to the restraining device 30 which is placed in this area. As can be seen, step 10 is rotatably attached at connection 60 to step chain 12. A support arm 16 carrying the step roller 18 is attached via flange 62 to step 10. The step chain 12 comprises a plurality of chain links 64 which are attached serially one after the other at joints 66. Step chain roller 68 are also attached to the corresponding joints 66. While the step rollers 18 are guided in a step roller track 20, a separate chain roller track is provided for guiding the chain rollers 68. With respect to the particular construction of this step/step chain combination, reference is made to WO 02/44069 A1, entitled CHAIN SEGMENT FOR PERSONAL CONVEYOR and filed by the same applicants as the present invention, the complete disclosure of which is hereby incorporated by reference into the present application.

Figure 7:
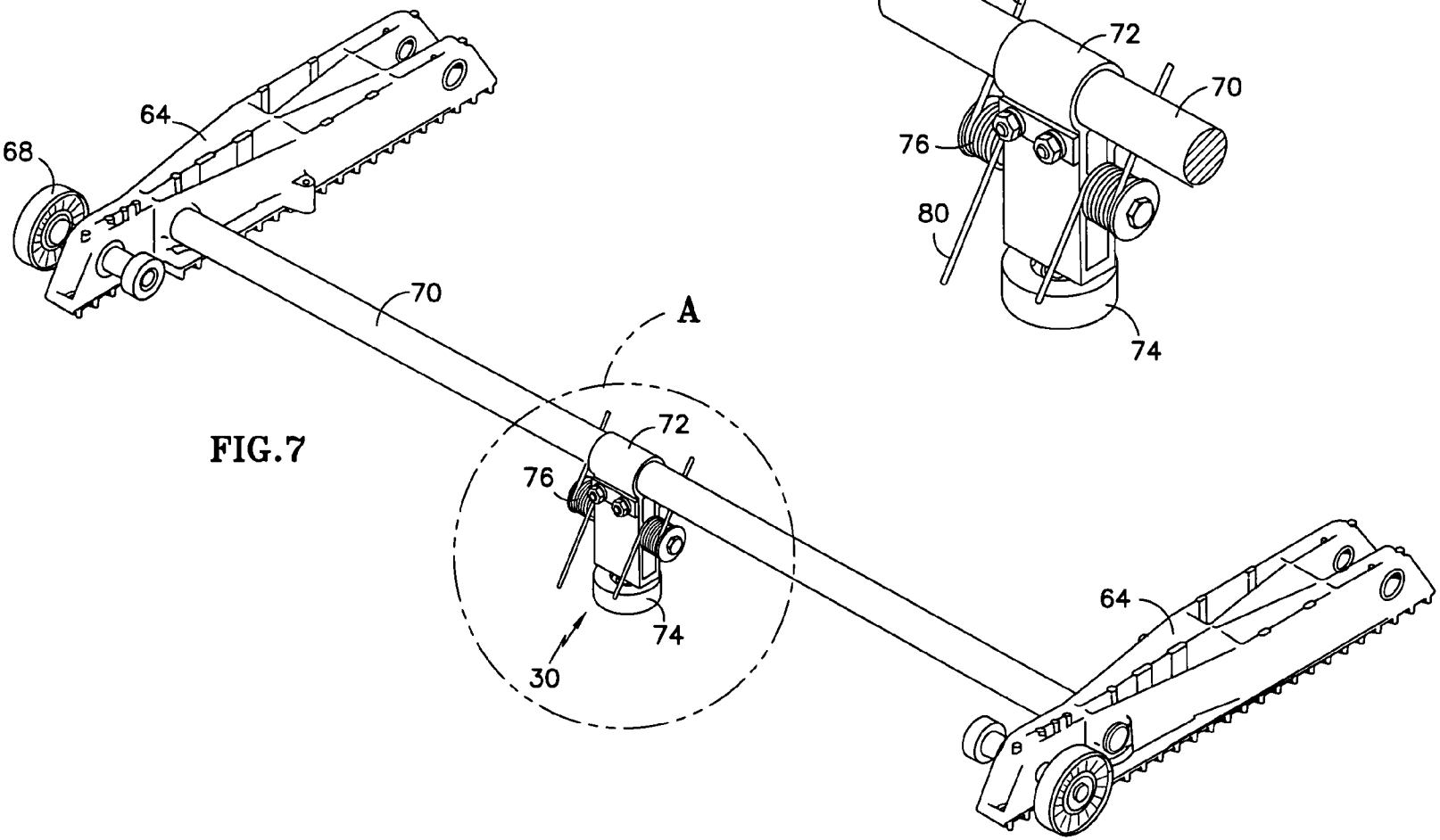
FIG. 7 is a view similar to that of FIG. 6, but with the step removed for clarity.

FIG. 7 is similar to FIG. 6 with the main exception that the step 12 be removed. Particularly, FIG. 7 shows that two opposite chain links 64 are connected with each other by means of a connecting axle 70. Substantially midways between the two chain links 64 a bracket 72 is mounted to the connecting axle 70 for supporting a lateral guide roller 74. Attached to such bracket 72 are also two tortion springs 76 each having one free end 78 supported against the connecting axle 70. The second free end 80 is operationally engaged with the step riser 58 as can be seen in FIGS. 6 and 9.

Figure 9:
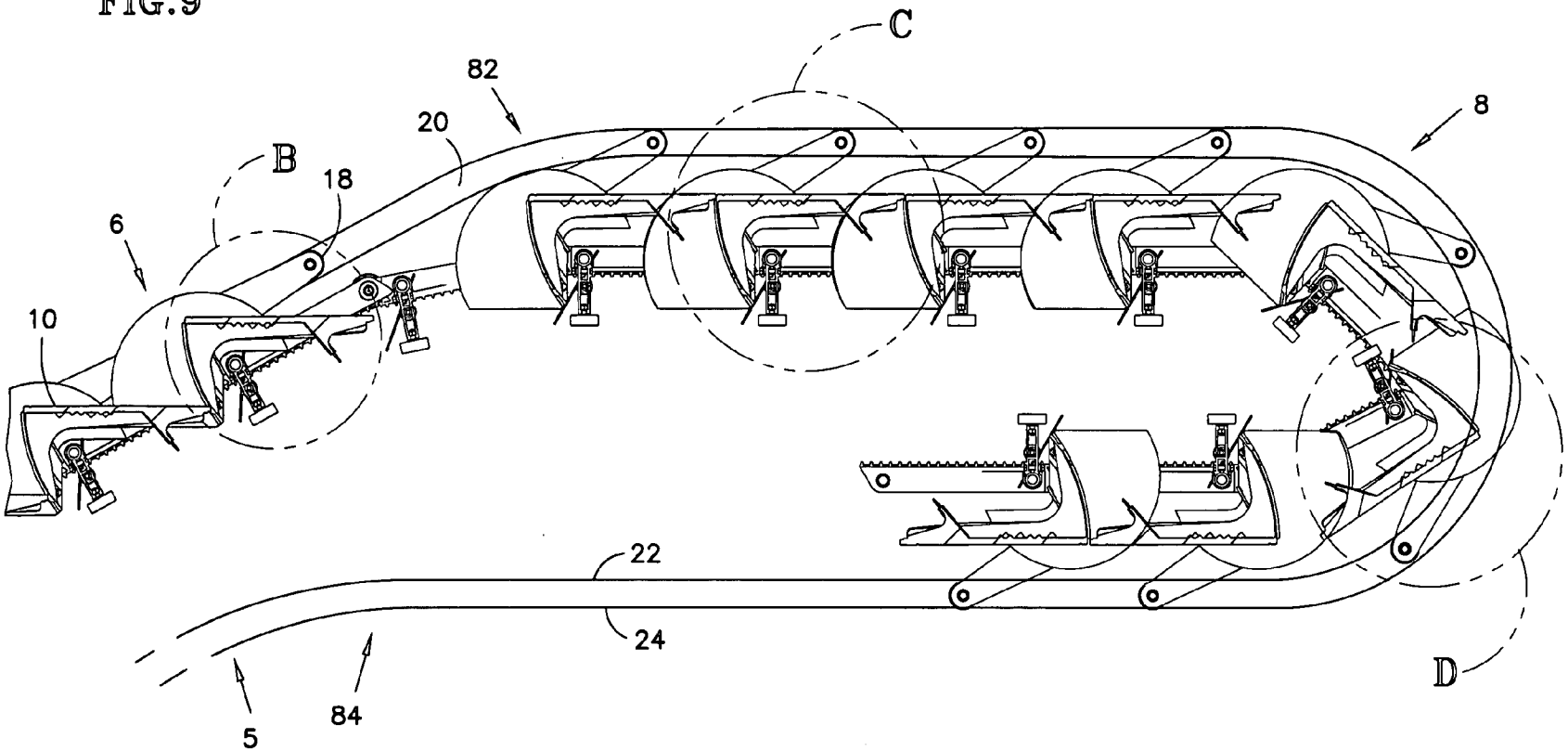
FIG. 9 is a side view showing the transition of a step through the upper turnaround area of an escalator in accordance with the second embodiment of the present invention.
Figure 10:
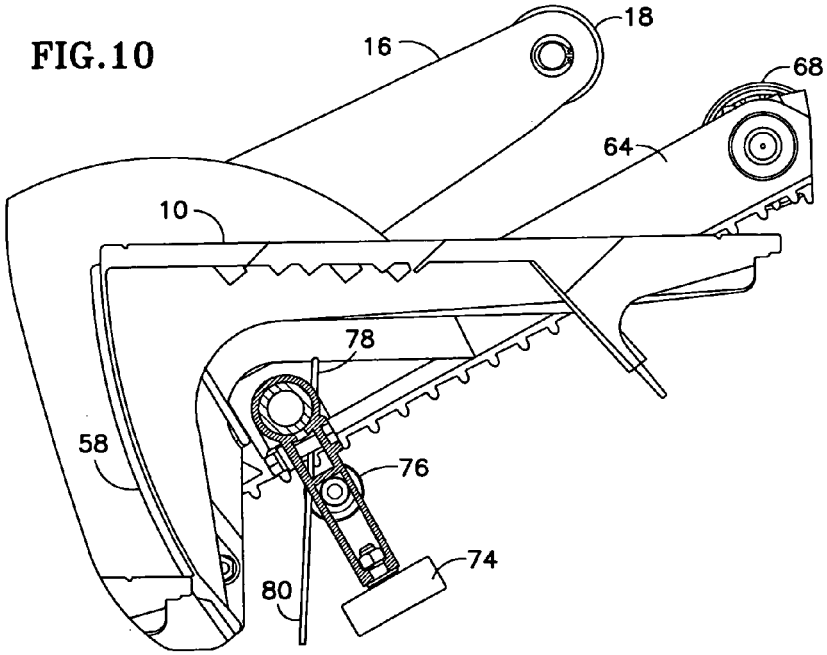
FIG. 10 is a detail as encircled by circle B in FIG. 9.
Figure 11:
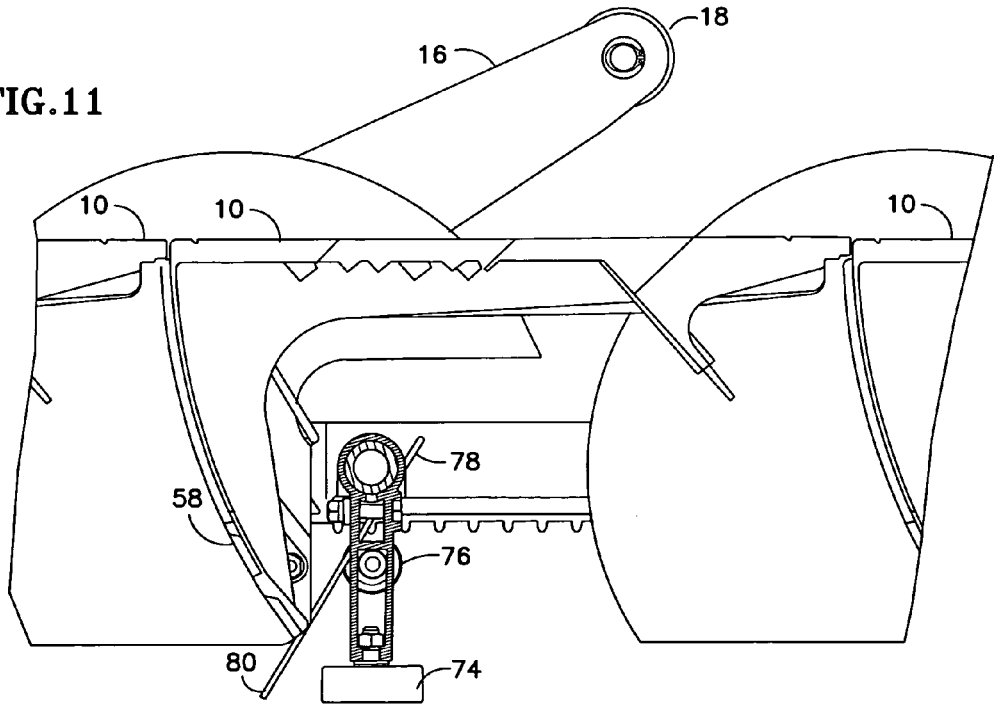
FIG. 11 is a detail as encircled by circle C in FIG. 9.
Figure 12:
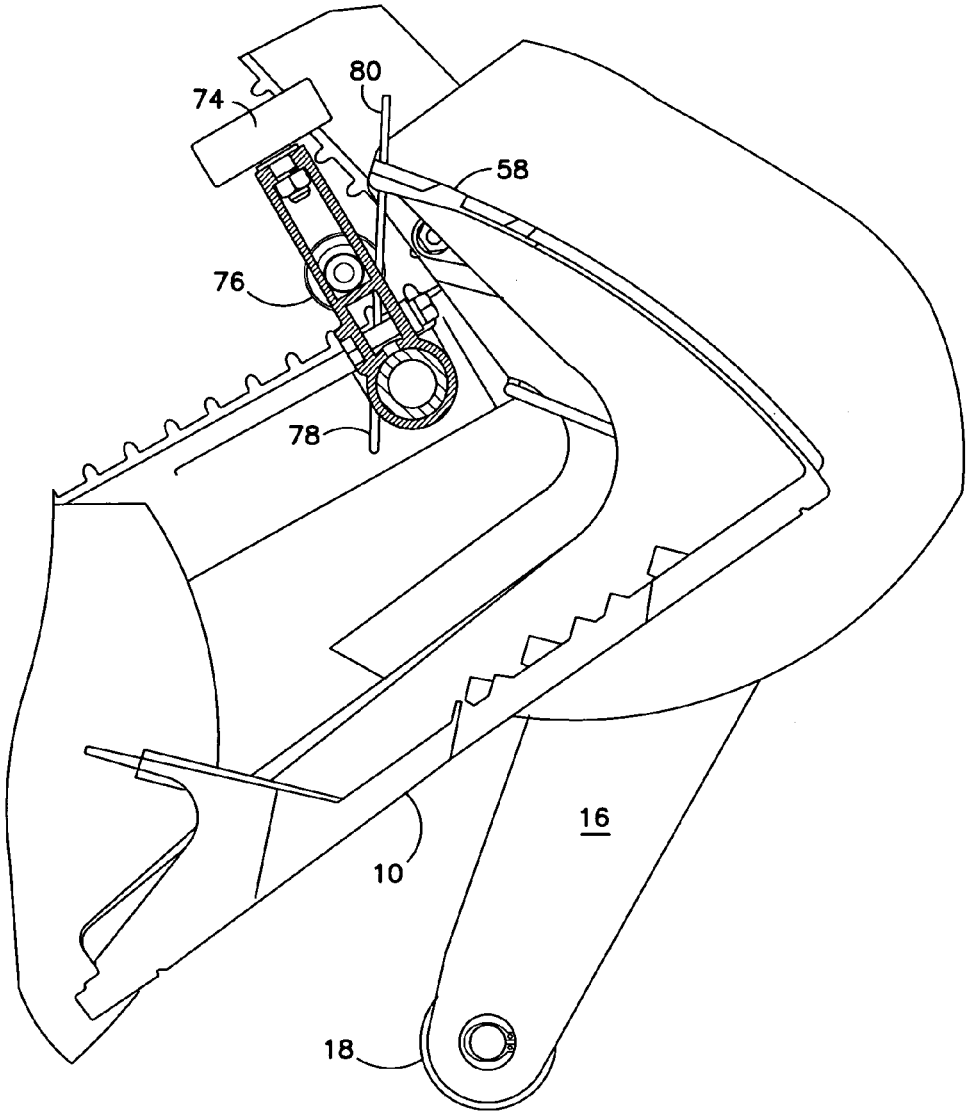
FIG. 12 is a detail as encircled by circle D in FIG. 9.

FIG. 9 shows schematically a part of the endless path of the endless conveyor band 4 and particularly shows the steps 10 moving through a passenger conveying portion 6 or "inclined portion" with an escalator, through a transition portion 82, a turnaround portion 8, a further transition portion 84 and towards a return portion 5. As can be seen, the step rollers 18 are guided in the step roller track 20. Detail B in FIG. 10 clearly shows the second free end of portion spring 76 out of engagement from the step riser 58. Only during the passage through the first transition portion 82 the second free end 80 of torsion spring 76 comes in engagement with the riser 58 of step 10 as can be seen in detail C of FIG. 11.

As the step 10 is rotatably connected to the step chain 12 at the connection 60, the engagement of the free end 8 of torsion spring 6 tends to rotate the step 10 around connection 60 clockwise and tends to restrain roller 18 against the inner rail 22 of step roller track 20. This engagement of the second free end 80 with the step riser 58 continues throughout the turnaround portion 8 and thus keeps the step roller 18 in engagement with the inner rail 22.

Depending on the strength of torsion spring 76, the torsion spring 76 may keep the step roller 18 in engagement with the inner rail 22 until the engagement of the free ends 80 with the riser 56 terminates in the second transition portion 84 and allows for a gradual changeover to the outer rail 24 in this area. Alternatively, the gravity load of the step 12 exceeds the force of torsion springs 76 in the course of moving through the turnaround portion 8 and allows for a smooth transition from the inner rail 22 to the outer rail 24 already in this area. During movement along the return path 5 the free ends 80 of torsion springs 76 are out of engagement with the step riser 58 so that the gravity load of the step 10 ensures engagement of the step roller 18 with the outer rail 24 in this portion. In a similar way such engagement and disengagement of the free end 80 of torsion spring 76 with step riser 58 occurs in the lower turnaround portion whereupon the second free end 80 of torsion spring 76 is again disengaged from the step riser 58 in the inclined or people conveyor portion 6. The operation is reversed if the transport direction of the people conveyor is reversed.

Preferably at least one restrain device 30 is provided with each step 10 of the step band.

As described above in detail, a device according to an embodiment of the present invention can restrain a step roller from rising toward an outer rail of a track at turn around areas of an escalator by a supplementary roller biased toward the outer rail of the track by an elastic member. This can prevent the shock and noise caused by the collision, thus providing the passengers with comfort and stability.

The invention claimed is:

1. People conveyor including an endless conveyor band extending through an inclined portion, a first and a second turnaround portions and a return portion of an endless path and comprising a plurality of steps connected to and driven by a step chain, the steps comprising a step roller, the people conveyor further including a step roller track for guiding the step roller, the step roller track extends along the path of the conveyor band and has an inner and an outer rails for supporting the step roller, and a device for restraining the step roller against one of the inner and outer rails, the restraining device is mounted to the step or to a connecting axle which connects one chain link on one side of the conveyor band with one chain link on the other side of the conveyor band so as to move together with the step.

2. People conveyor according to claim 1, wherein such restraining device comprises an elastic biasing member for elastically biasing the step roller against one of the inner and outer rails.

3. People conveyor according to claim 1, wherein the restraining device is adapted for allowing a gradual transition of the step roller from one of the inner and outer rails to the other one from inner and outer rails in any of the first and second turnaround portions.

4. People conveyor according to claim 1, wherein the restraining device is arranged between the step and the drive chain.

5. People conveyor according to claims 1, wherein one drive chain is arranged at each lateral edge of the conveyor band, wherein each step chain comprises a plurality of chain links and wherein a connecting axle connects one chain link on one side of the conveyor band with one chain link on the other side of the conveyor band, and wherein the restraining device is arranged between the step and the connecting axle.

6. People conveyor according to claim 5, wherein the restraining device comprises a torsion spring attached to the connecting axle and supported thereto with one of the free ends of such spring and having the second free end thereof arranged so as to engage the step.

7. People conveyor according to any claims 1, wherein the restraining device is arranged between the step and the step roller track.

8. People conveyor according to claim 7, wherein the restraining device comprises a supplementary roller and a biasing means for biasing the supplementary roller against one rail of the step roller track.

9. People conveyor according to claim 8, wherein the step roller is attached to the step by a connecting arm and wherein the supplementary roller is supported by the connecting arm.

10. People conveyor according to claim 8, wherein the biasing means biases the supplementary roller against the outer rail.

11. People conveyor according to claims 8, wherein the biasing means is a linear spring having a first leg and a second leg being bent with respect to each other by a predetermined angle, further comprising a supporting block at the support arm, the supporting block comprising a first and second recesses each portion of the first and second legs of the linear spring being respectively fitted to the first and second recesses to thereby limit deformation of the first and second legs of the linear spring to a predetermined range.

12. People conveyor according to claim 11, further comprising a cover mounted to the supporting block to prevent the first and second legs of the linear spring from being separated from the first and second recesses of the supporting block.

13. People conveyor according to claim 11, further comprising a member for supporting the supplementary roller, the member having a recess in which a portion adjacent to the junction between the first and second legs of the linear spring is fitted, and a cover which covers the recess of the member.

* * * * *